US005303455A

United States Patent [19]

Leifeld

[11] Patent Number: 5,303,455

[45] Date of Patent: Apr. 19, 1994

[54] APPARATUS FOR MAKING A FIBER LAP

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 791,177

[22] Filed: Nov. 13, 1991

[30] Foreign Application Priority Data

Nov. 13, 1990 [DE] Fed. Rep. of Germany ..... 4036014

[51] Int. Cl.[5] ..... D01G 23/00; D01G 25/00; B65G 53/00

[52] U.S. Cl. ..... 19/304; 19/200; 19/105; 209/135

[58] Field of Search ..... 19/65 R, 65 A, 66 R, 19/105, 145.5, 296, 303, 304, 305, 306, 307, 308, 58, 59, 63; 209/21, 27, 134, 135, 136, 137, 138, 143, 149; 406/98, 106, 168, 171

[56] References Cited

U.S. PATENT DOCUMENTS

| | | | |
|---|---|---|---|
| 1,375,985 | 4/1921 | Vardell | 19/58 |
| 1,375,986 | 4/1921 | Vardell | 19/58 |
| 2,014,673 | 9/1935 | Setzer | 19/112 X |
| 2,607,958 | 8/1952 | Rusca et al. | 19/58 X |
| 2,968,069 | 1/1961 | Powell | 209/135 X |
| 3,006,410 | 10/1961 | Ferla | 19/304 X |
| 3,037,248 | 6/1962 | Callaghan | 19/307 X |
| 3,051,998 | 9/1962 | Rust, Jr. et al. | 19/307 |
| 3,111,719 | 11/1963 | Novotny | 19/200 |
| 3,121,921 | 2/1964 | Latour | 19/59 X |
| 3,228,067 | 1/1966 | Strang et al. | 19/304 X |
| 3,256,569 | 6/1966 | Draving | 19/305 |
| 3,641,628 | 2/1972 | Fehrer | 19/307 |
| 3,792,943 | 2/1974 | Helgesson | 19/304 X |
| 3,815,178 | 6/1974 | Goldman | 19/303 X |
| 4,130,915 | 12/1978 | Gotchel et al. | 19/304 |
| 4,150,461 | 4/1979 | Leifeld | 19/303 X |
| 4,223,423 | 9/1990 | Foerster | 19/303 X |
| 4,506,413 | 3/1985 | Leifeld | 19/105 |
| 4,574,433 | 3/1986 | Brunnschweiler | 19/105 |
| 4,706,338 | 11/1987 | Anspach | 19/304 X |
| 4,712,277 | 12/1987 | Gustavsson | 19/304 X |
| 4,765,780 | 8/1988 | Angstadt | 406/181 X |
| 4,779,311 | 10/1988 | Leifeld | 19/105 |

FOREIGN PATENT DOCUMENTS

| | | | |
|---|---|---|---|
| 0376598 | 12/1921 | Fed. Rep. of Germany | 19/156 |
| 704915 | 5/1941 | Fed. Rep. of Germany . | |
| 2628669 | 1/1977 | Fed. Rep. of Germany . | |
| 2635534 | 3/1977 | Fed. Rep. of Germany . | |
| 3325669 | 5/1986 | Fed. Rep. of Germany . | |
| 0248149 | 7/1987 | Fed. Rep. of Germany | 19/304 |
| 3617525 | 11/1987 | Fed. Rep. of Germany . | |
| 3522208 | 4/1988 | Fed. Rep. of Germany . | |
| 3906640 | 2/1990 | Fed. Rep. of Germany . | |
| 2004800 | 12/1969 | France | 19/145.5 |
| 0328595 | 3/1972 | U.S.S.R. | 19/145.5 |

*Primary Examiner*—Clifford D. Crowder
*Assistant Examiner*—Ismael Izaguirre
*Attorney, Agent, or Firm*—Spencer, Frank & Schneider

[57] ABSTRACT

An apparatus for forming a fiber lap from fiber tufts includes a fiber opener having an input formed of a fiber feeding mechanism and a series of sawtooth rolls through which the fiber material introduced by the fiber feeding mechanism consecutively passes in a direction of advance; a pneumatic fiber stripping device including a blowing device for directing an airstream toward the last sawtooth roll of the series as viewed in the direction of fiber advance; a hood having an inner face defining a chamber situated above and downstream of the last sawtooth roll for receiving fiber material carried from the last sawtooth roll by the air stream of the fiber stripping device; an air-pervious, continuously moving receiving member disposed in the chamber downstream of the last sawtooth roll; and a suction device facing the underside of the receiving member for generating an air stream passing through the receiving member for drawing fiber material in the chamber onto the upper face of the receiving member for forming a fiber lap thereon.

10 Claims, 5 Drawing Sheets

APPARATUS FOR MAKING A FIBER LAP

CROSS REFERENCE TO RELATED APPLICATION

This application claims the priority of German Application No. P 40 36 014.8 filed Nov. 13, 1990, which is incorporated herein by reference.

BACKGROUND OF THE INVENTION

1. Field of the Invention

This invention relates to an apparatus for making a fiber lap from chemical fibers, cotton or the like. The fiber lap is utilized, as a more or less coherent mass, as the input material for further fiber processing such as carding, cleaning and the like. The lap forming apparatus is of the type which includes a fiber opening device having a fiber feeding device at its input and a series of rotating sawtooth rolls and a depositing channel in which the fiber material thrown by the last sawtooth roll is deposited on a continuously moving, fiber-supporting surface which is air-pervious and is exposed to suction for causing the fiber tufts to temporarily adhere thereon.

2. Background Information

In a known apparatus of the above-outlined type such as disclosed, for example, in German Patent No. 3,522,208, an endless circulating screening belt is, as a fiber receiving surface, positioned underneath a plurality of sawtooth rolls (carding cylinders). The sawtooth rolls throw the fiber material tangentially downwardly onto the upper surface of the travelling screen belt. The air needed for the conveying air stream between adjoining sawtooth rolls is drawn in between the sawtooth rolls from supply air channels arranged above the bight of the rolls. In this manner, with each sawtooth roll there is associated a downwardly oriented suction stream.

It is a disadvantage of the known prior art construction in that it is technologically complex, and that the individual sawtooth rolls discharge the fiber material onto the screen belt at different flow rates.

SUMMARY OF THE INVENTION

It is an object of the invention to provide an improved apparatus of the above-outlined type from which the discussed disadvantages are eliminated and which, in particular, is structurally simpler and ensures the formation of a more uniform fiber lap.

This object and others to become apparent as the specification progresses, are accomplished by the invention, according to which, briefly stated, the apparatus for forming a fiber lap from fiber tufts includes a fiber opener having an input formed of a fiber feeding mechanism and a series of sawtooth rolls through which the fiber material introduced by the fiber feeding mechanism consecutively passes in a direction of advance; a pneumatic fiber stripping device including a blowing device for directing an airstream toward the last sawtooth roll of the series as viewed in the direction of fiber advance; a hood having an inner face defining a chamber situated above and downstream of the last sawtooth roll for receiving fiber material carried from the last sawtooth roll by the air stream of the fiber stripping device; an air-pervious, continuously moving receiving member disposed in the chamber downstream of the last sawtooth roll; and a suction device facing the underside of the receiving member for generating an air stream passing through the receiving member for drawing fiber material in the chamber onto the upper face of the receiving member for forming a fiber lap thereon.

By virtue of the fact that the fiber receiving member, such as an endless screen belt, is arranged downstream of the fiber opening assembly, as viewed in the direction of fiber feed, each sawtooth roll is able to perform a more intensive opening and cleaning operation and a separation of function between opening and cleaning on the one hand and fiber lap forming on the other hand is provided. The fiber-stripping air stream directed to the last sawtooth roll of the fiber opener drives the fiber material into a space above the screen belt where the fiber undergoes turbulent agitation and subsequently falls downwardly onto the screen belt. During this occurrence the fiber material which is drawn to the screen belt by a suction stream, automatically fills up the valleys formed on the screen belt, whereby a fiber lap of uniform thickness is obtained.

DESCRIPTION OF THE PREFERRED EMBODIMENTS

Figure 1:
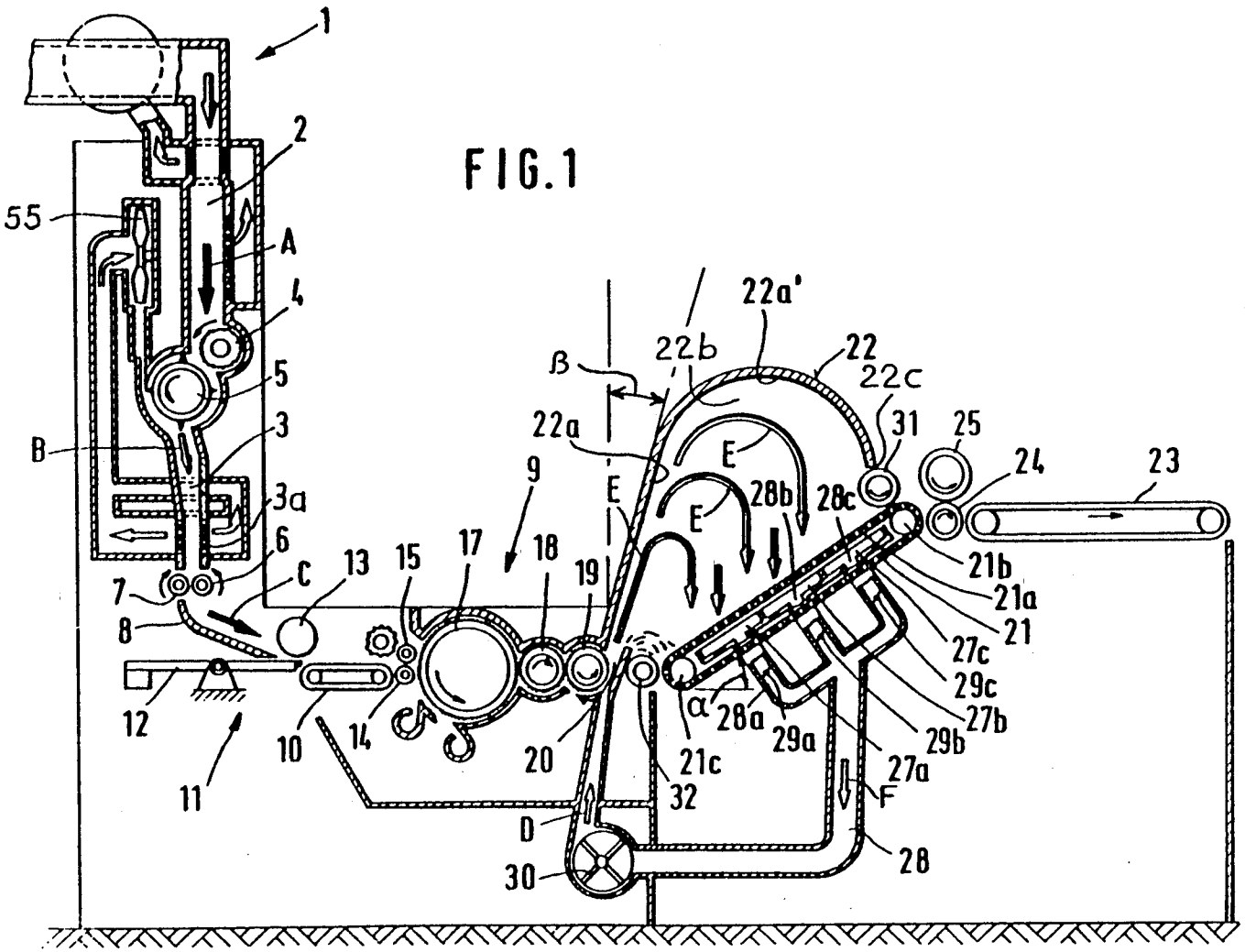
FIG. 1 is a schematic side elevational of the invention.

Turning to FIG. 1, there is illustrated therein a known fiber tuft feeder 1 which may be, for example, an EXACTAFEED FBK model, manufactured by Trützschler GmbH & Co. KG, Mönchengladbach, Germany. The fiber tuft feeder 1 has an upper, reserve chute 2 and a lower, feed chute 3 between which a feed roll 4 and an opening roll 5 are positioned, which forward the fiber material A from the reserve chute 2 into the feed chute 3. A fan 55 drives air tangentially past the opening roll 5 into the feed chute 3 for forming an air/-fiber mixture B and for densifying the fiber column which builds up in the feed chute 3. The air driven by the fan 55 is recirculated by withdrawing air through apertures 3*a* provided in a lower part of the feed chute 3. At the bottom end of the feed chute 3 cooperating delivery rolls 6 and 7 are provided which withdraw the fiber material from the feed chute 3 and forward the same onto a guide tray 8 on which the fiber material is, as a preliminary fiber lap C, advanced to a fiber lap regulator 11 formed of a lap thickness or density measuring device 12 composed, for example, of a plurality of sensor pedals and a counterroll 13. Thereafter, the fiber lap is forwarded by a conveyor belt 10 to feed rolls 14, 15 of a fiber opening apparatus 9.

The fiber opening apparatus 9 further comprises three serially arranged sawtooth rolls 17, 18 and 19. The last sawtooth roll 19 is associated with a pneumatic fiber-stripping device 20 ejecting the fibers upwardly from the sawtooth roll 19. Downstream of the fiber-stripping device 20 there is arranged an endless screen belt 21 supported by end rolls 21*b* and 21*c*. The screen belt 21 is inclined upwardly at an angle $\alpha$ to the horizontal in the working direction. Above the screen belt 21 a downwardly open hood 22 is provided which encloses a receiving chamber 22b into which the fiber is thrown from the sawtooth roll 19 by the stripping device 20. The hood 22 has an inner wall surface portion 22a which extends upwardly from the sawtooth roll 19 and which is inclined at an angle $\beta$ to the vertical and extends over the screen belt 21. Thus, the inner wall surface 22a is inclined toward the screen belt 21 at an acute angle of $90-(\alpha+\beta)$ degrees. The upper end of the inner wall surface 22a is adjoined by a curved inner wall surface 22a' closing the hood 22 and terminating adjacent the upper end of the screen belt 21. The fiber material is guided by the air stream of the stripping device 20 along the rising inner wall surface portion 22a of the hood 22 and is directed as an air/fiber mixture, in a distribution shown by arrows E, onto the upper surface of the working flight 21a of the screen belt 21. A fiber lap removal device 23 comprising, for example, a conveyor belt, is arranged downstream of the screen belt 21.

The fiber stripping device 20 is arranged tangentially to the last sawtooth roll 19 and directs an air stream D in the upward direction. The underside of the working flight 21a of the screen belt 21 is exposed to suction by serially arranged suction boxes 27a, 27b and 27c which are coupled to a common suction conduit 28 by individual suction conduits 28a, 28b and 28c, respectively. Each suction conduit 28a, 28b and 28c accommodates a respective throttle gate 29a, 29b and 29c for setting the flow rate of the suction stream for each suction box 27a, 27b and 27c.

Between the suction conduit 28 and the fiber stripping device 20 a fan 30 is provided which supplies, in recirculation, the stripping air stream D, the conveying air stream E as well as the suction air stream F. At the discharge end of the screen belt 21 there is provided, between the end roller 21b and the lower boundary of the receiving chamber 22b, a sealing roller 31 which is situated between the upper face of the belt flight 21a and a terminal edge 22c of the hood 22 to obturate the clearance between the belt 21 and the hood 22. Further, at the upstream end of the screen belt 21, between the fiber stripping device 20 and the end roll 21c, a sealing roller 32 is provided which obturates the space between the outlet of the stripping device 20 and the screen belt 21. Between the screen belt 21 and the fiber lap removing device 23 two cooperating calender rolls 24 and 25 are positioned. As an alternative to the screen belt, it is feasible to use a rotary screen drum which is exposed to suction by a vacuum device situated inside the drum.

Figure 2:
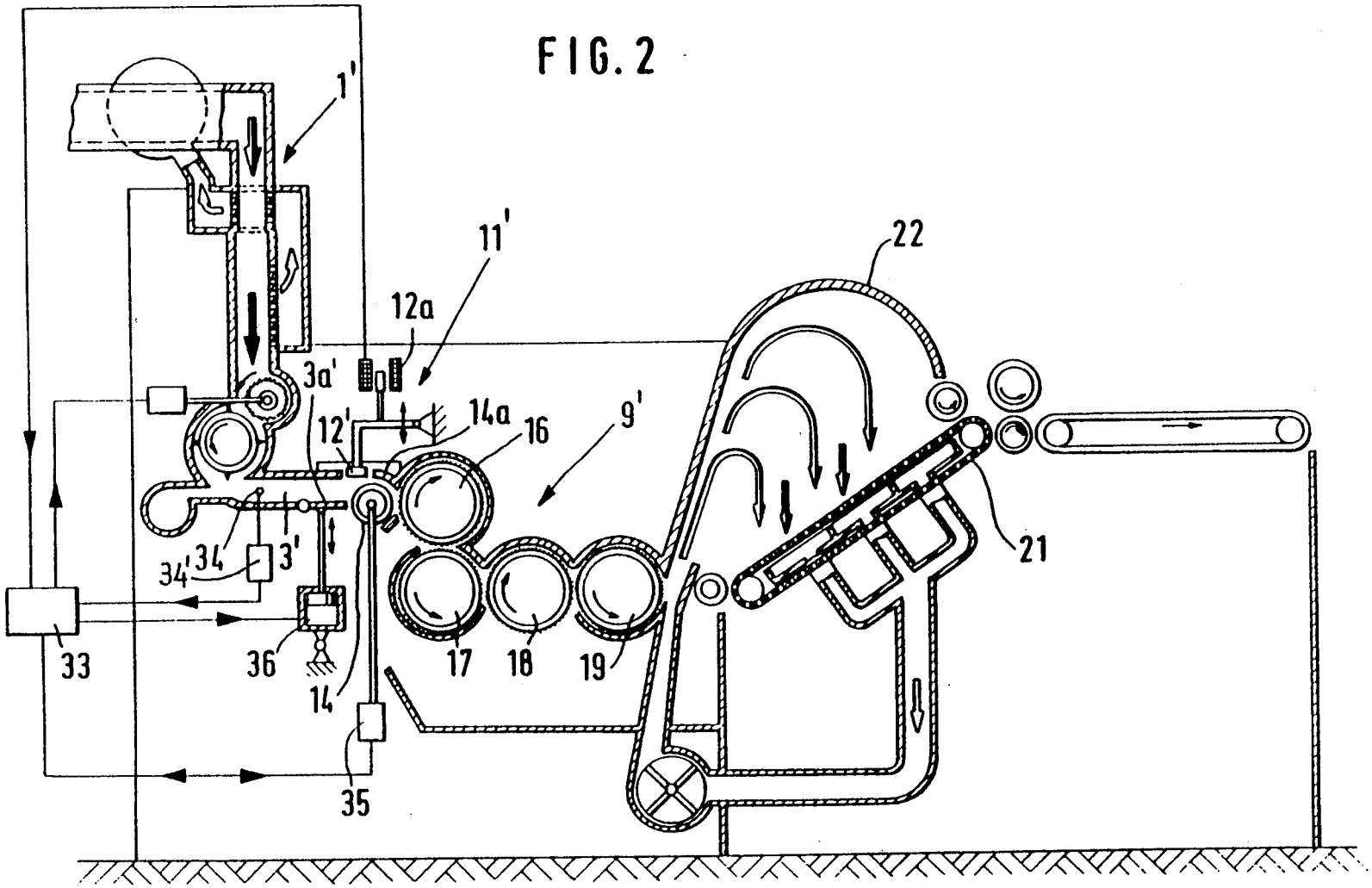
FIG. 2 is a schematic side elevational view of a second preferred embodiment of the invention.

Turning to FIG. 2, in the embodiment illustrated therein a device 11' for regulating the thickness of a preliminary fiber lap is situated immediately upstream of the input side of the fiber opening apparatus 9'. The measuring member 12' which passes through the feed table 14a cooperates with an inductive path sensor 12a which, in turn, is electrically connected with a control and regulating device 33. Further, a pressure sensor 34 arranged in the horizontal feed chute 3' applies sensor signals via a transducer 34' to the control and regulating apparatus 33. The latter, in turn, controls a speed variable motor 35 which operates the feed roll 14. The control and regulating device 33 also controls a pneumatic cylinder unit 36 for varying the width of the feed chute 3' in the zone of the air outlet openings 3a', as well as the rpm of the feed roll 4 of the fiber tuft feeder 1'.

Figure 3:
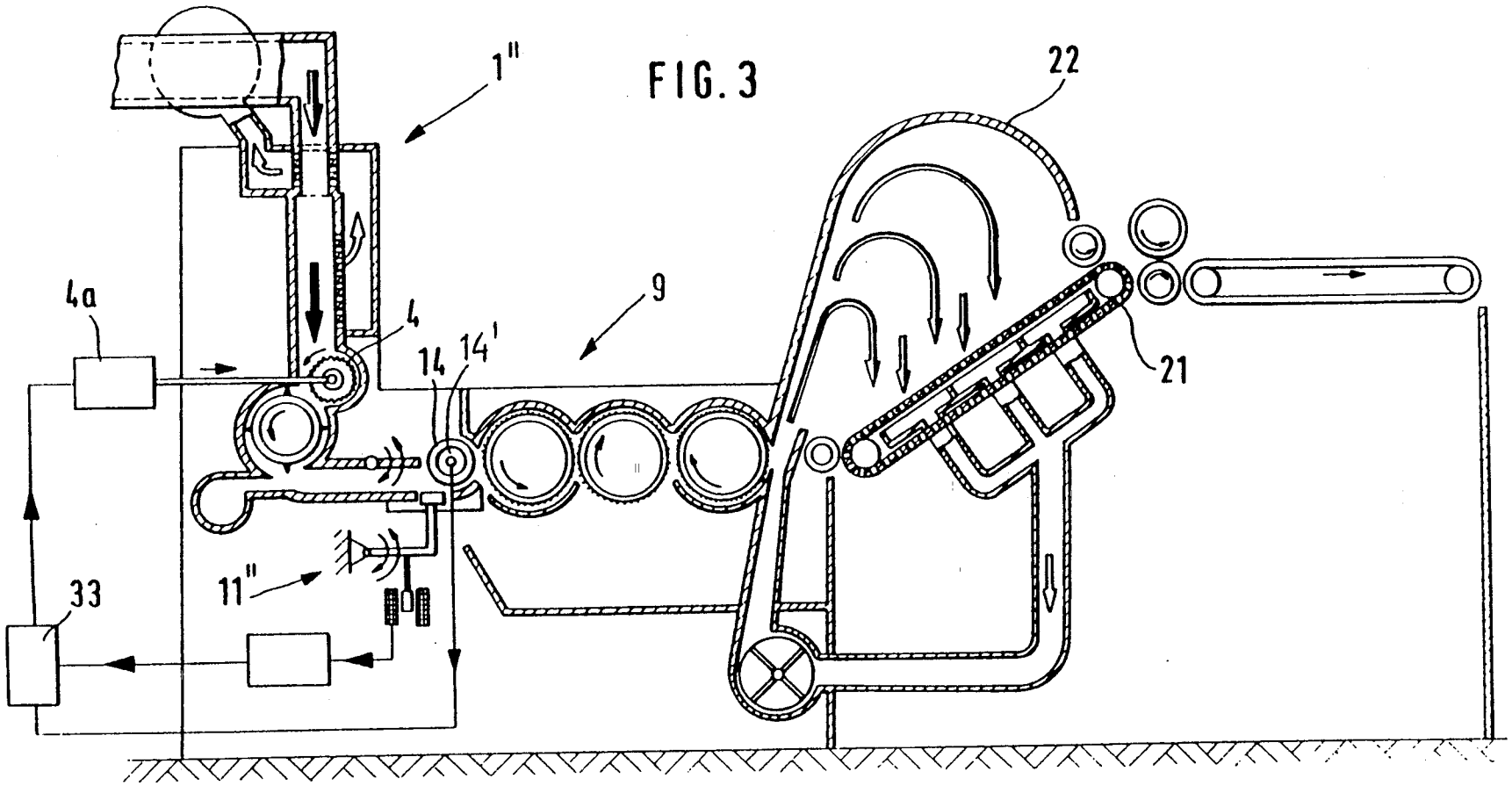
FIG. 3 is a schematic side elevational view of a third preferred embodiment of the invention.

Turning to FIG. 3, the rpm of the feed roll 4 of the fiber tuft feeder 1'' is varied by a setting member, such as a speed variable drive motor 4a. The feed roll 14 of the fiber opener 9 is associated with an rpm regulator, such as a tachogenerator 14' which is coupled to the control and regulating device 33. Further, the fiber lap regulator 11'' is coupled to the control and regulator device 33.

Figure 4:
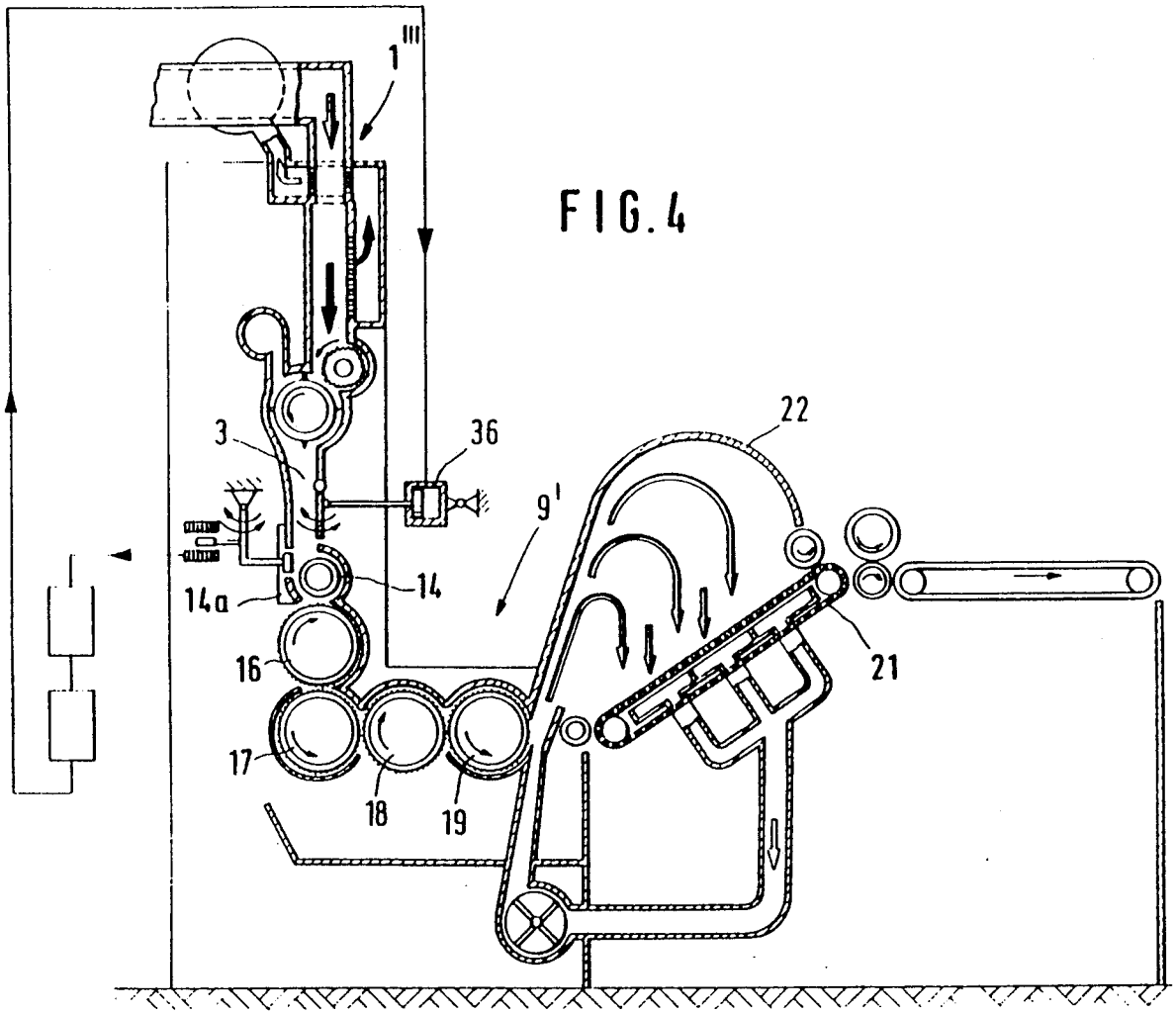
FIG. 4 is a schematic side elevational view of a fourth preferred embodiment of the invention.

In the embodiment according to FIG. 4, similarly to the embodiment of FIG. 2, the first (upstream) sawtooth roll 16 of the fiber opener 9' is arranged above the second sawtooth roll 17. The feed roll 14 of the fiber opener 9' and the associated feed table 14a which both are situated above the first sawtooth roll 16, constitute the fiber tuft withdrawing device to remove fiber from the downstream end of the feed chute 3 of the fiber tuft feeder 1'''.

Figure 5:
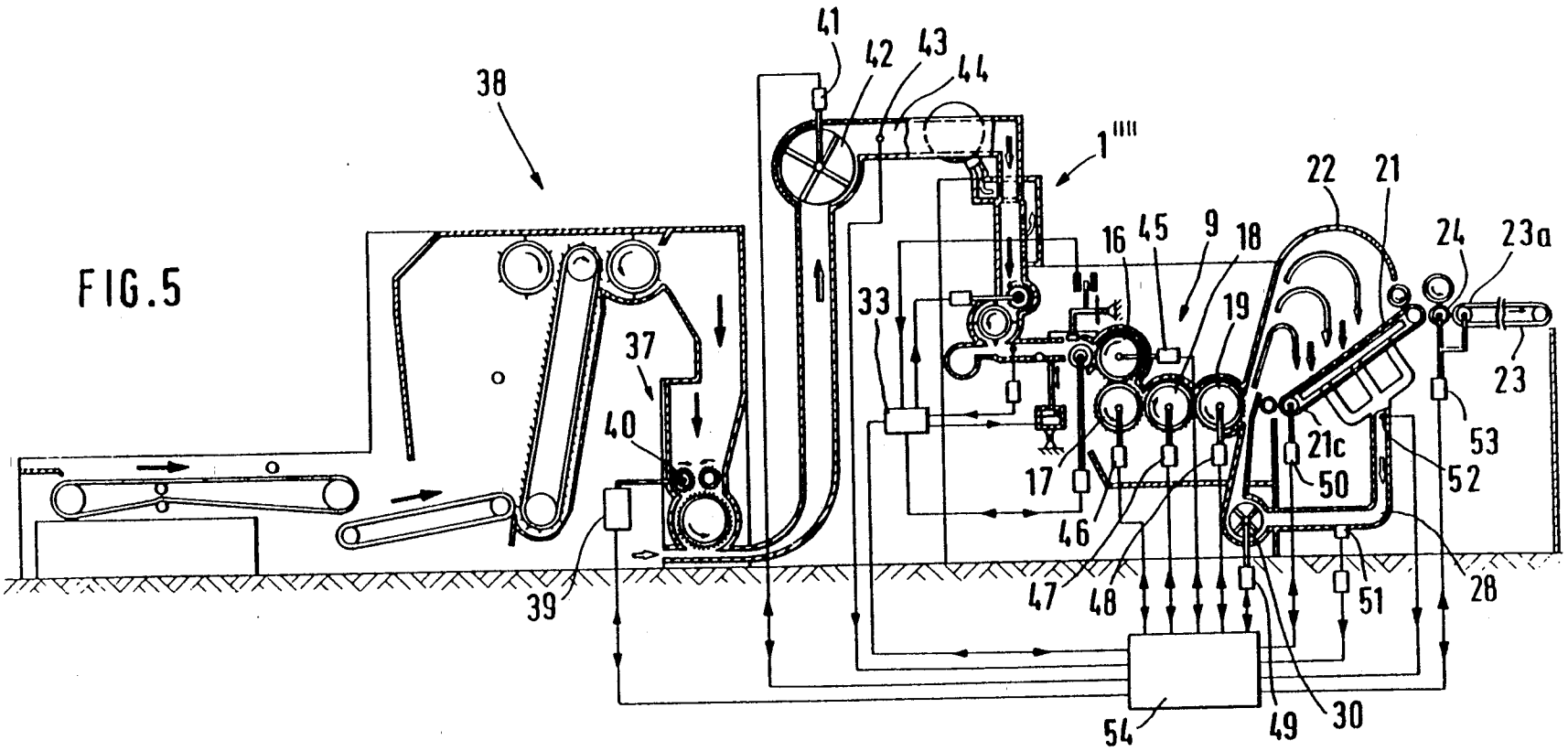
FIG. 5 is a schematic side elevational view of a fifth preferred embodiment of the invention.

Turning to the embodiment illustrated in FIG. 5, upstream of the fiber tuft feeder 1'''' there is disposed a supply device 37 (including a chute, intake rolls 40 and a rapidly rotating opening roll) as well as a feed box assembly 38. To a master control and regulating device 54 there are connected, as measuring and setting members, a speed variable drive motor 39 for the intake roll 40 of the supply device 37, a speed variable drive motor 41 for a fiber conveying fan 42, a pressure sensor 43 situated in the fiber conveying conduit 44, the control and regulating device 33, speed variable drive motors 45, 46, 47 and 48 for the sawtooth rolls 16, 17, 18 and 19, a speed variable drive motor 49 for the fan 30, a speed variable drive motor 50 for the belt end roll 21c, an air quantity measuring device 51 and a pressure sensor 52 attached to the suction conduit 28 and a speed variable drive motor 53 for the calender rolls 24, 25 and the belt end roll 23a of the fiber removal belt 23.

It will be understood that the above description of the present invention is susceptible to various modifications, changes and adaptations, and the same are intended to be comprehended within the meaning and range of equivalents of the appended claims.

What is claimed is:

1. An apparatus for forming a fiber lap from fiber tufts in combination with a fiber tuft feeder having an outlet; said apparatus comprising (a) a fiber opener having an input formed of a fiber feeding mechanism and a series of sawtooth rolls through which the fiber material introduced by the fiber feeding mechanism consecutively passes in a direction of advance; said fiber feeding mechanism receiving fiber material from aid outlet;

(b) a pneumatic fiber stripping device including blowing means for directing an airstream toward the last sawtooth roll of the series as viewed in said direction of advance;

(c) a hood having an inner face defining a chamber situated above and downstream of said last sawtooth roll for receiving fiber material carried from the last sawtooth roll by the air stream of said fiber stripping device; said inner face having an inner wall surface portion extending upwardly from said last sawtooth roll at an oblique angle to the vertical;

(d) an air-pervious receiving member having an upper face and an underside; said receiving member being disposed in said chamber downstream of said last sawtooth roll; said inner wall surface portion extending over said upper face of the receiving member and being inclined at an acute angle to said receiving member; said blowing means and said inner wall surface portion being oriented such that the fiber material stripped from said last sawtooth roll is guided along said inner wall surface portion prior to the deposition of the fiber material on said upper face of said receiving member;

(e) means for continuously moving said receiving member;

(f) suction means facing said underside of said receiving member for generating an air stream passing through said receiving member in a direction from said upper face to said underside for drawing fiber material in said chamber onto said upper face of said receiving member for forming said fiber lap thereon;

(g) means for forming a preliminary fiber lap between said outlet and said fiber feeding mechanism; and (h) a device for regulating a thickness of said preliminary fiber lap between said outlet and said fiber feeding mechanism.

2. The apparatus as defined in claim 1, wherein said blowing means is oriented upwardly and tangentially to said last sawtooth roll.

3. An apparatus for forming a fiber lap from fiber tufts, comprising (a) a fiber opener having an input formed of a fiber feeding mechanism and a series of sawtooth rolls through which the fiber material introduced by the fiber feeding mechanism consecutively passes in a direction of advance;

(b) a pneumatic fiber stripping device including blowing means for directing an airstream toward the last sawtooth roll of the series as viewed in said direction of advance;

(c) a hood having an inner face defining a chamber situated above and downstream of said last sawtooth roll for receiving fiber material carried from the last sawtooth roll by the air stream of said fiber stripping device; said inner face having an inner wall surface portion extending upwardly from said last sawtooth roll at an oblique angle to the vertical;

(d) an air-pervious receiving member having an upper face and an underside; said receiving member being disposed in said chamber downstream of said last sawtooth roll; said inner wall surface portion extending over said upper face of the receiving member and being inclined at an acute angle to said receiving member; said blowing means and said inner wall surface portion being oriented such that the fiber material striped from said last sawtooth roll is guided along said inner wall surface portion prior to the deposition of the fiber material on said upper face of said receiving member;

(e) means for continuously moving said receiving member;

(f) suction means facing said underside of said receiving member for generating an air stream passing through said receiving member in a direction from said upper face to said underside for drawing fiber material in said chamber onto said upper face of said receiving member for forming said fiber lap thereon; said suction means comprising a suction source, a plurality of juxtapositioned suction boxes each having a suction opening oriented towards said underside of said receiving member and a suction conduit operatively coupled to said suction source; and (g) an adjustable throttle member disposed in each suction conduit for controlling an air flow rate individually through each said suction box.

4. An apparatus for forming a fiber lap from fiber tufts, comprising (a) a fiber opener having an input formed of a fiber feeding mechanism and a series of sawtooth rolls through which the fiber material introduced by the fiber feeding mechanism consecutively passes in a direction of advance;

(b) a pneumatic fiber stripping device including blowing means for directing an airstream toward the last sawtooth roll of the series as viewed in said direction of advance;

(c) a hood having an inner face defining a chamber situated above and downstream of said last sawtooth roll for receiving fiber material carried from the last sawtooth roll by the air stream of said fiber stripping device; said inner face having an inner wall surface portion extending upwardly from said last sawtooth roll at an oblique angle to the vertical;

(d) an air-pervious receiving member having an upper face and an underside; said receiving member being disposed in said chamber downstream of said last sawtooth roll; said inner wall surface portion extending over said upper face of the receiving member and being inclined at an acute angle to said receiving member; said blowing means and said inner wall surface portion being oriented such that the fiber material stripped from said last sawtooth roll is guided along said inner wall surface portion prior to the deposition of the fiber material on said upper face of said receiving member;

(e) means for continuously moving said receiving member;

(f) suction means facing said underside of said receiving member for generating an air stream passing through said receiving member in a direction from said upper face to said underside for drawing fiber material in said chamber onto said upper face of said receiving member for forming said fiber lap thereon; said suction means comprising a suction source, a plurality of juxtapositioned suction boxes each having a suction opening oriented towards said underside of said receiving member and a suction conduit operatively coupled to said suction source; and (g) a blower having an air discharge side constituting said blowing means and an air intake side constituting said suction source.

5. The apparatus as defined in claim 1, wherein said receiving member comprises an endless, air-pervious conveyor belt including a working flight having said upper face and said underside.

6. The apparatus as defined in claim 5, wherein said working flight of said conveyor belt is sloping upwardly in a direction of movement of said working flight.

7. The apparatus as defined in claim 5, further comprising a first and a second end roller supporting and positioning said endless conveyor belt.

8. The apparatus as defined in claim 7, wherein said blowing means has an outlet situated at a clearance from said second end roller; further comprising a sealing roller positioned in said clearance.

9. The apparatus as defined in claim 7, wherein said hood comprises a lower edge disposed above said first end roller at a clearance therefrom; further comprising a sealing roller positioned in said clearance.

10. The apparatus as defined in claim 4, further comprising (g) a separate speed variable motor drivingly connected to said fiber feeding mechanism, said sawtooth rolls, said blower, and said means for continuously moving said receiving member;

(h) a separate sensor operatively connected to said fiber feeding mechanism, said sawtooth rolls, said blower and said means for continuously moving said receiving member; and (i) a control and regulating device connected to each said motor and each said sensor.

* * * * *